US007866801B2

(12) United States Patent
Ishizawa et al.

(10) Patent No.: US 7,866,801 B2
(45) Date of Patent: Jan. 11, 2011

(54) LIQUID-SUPPLYING SYSTEM AND LIQUID-CONSUMING APPARATUS

(75) Inventors: Taku Ishizawa, Matsumoto (JP); Satoshi Shinada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 838 days.

(21) Appl. No.: 11/775,578

(22) Filed: Jul. 10, 2007

(65) Prior Publication Data

US 2008/0006332 A1 Jan. 10, 2008

(30) Foreign Application Priority Data

Jul. 10, 2006 (JP) ..... 2006-189714
Jun. 19, 2007 (JP) ..... 2007-161204

(51) Int. Cl.
*B41J 2/175* (2006.01)
*B41J 2/195* (2006.01)

(52) U.S. Cl. ..... 347/85; 347/7

(58) Field of Classification Search ..... 347/7, 347/19, 85; 73/1.15, 1.73, 1.82, 1.83, 290 R
See application file for complete search history.

(56) References Cited

U.S. PATENT DOCUMENTS 4,580,448 A * 4/1986 Skrgatic ..... 73/290 V
4,636,814 A * 1/1987 Terasawa ..... 347/86
4,770,038 A * 9/1988 Zuckerwar et al. ..... 73/290 V
6,663,233 B2 * 12/2003 Otsuka et al. ..... 347/85
6,745,626 B2 * 6/2004 Usui et al. ..... 73/290 R
7,155,972 B2 1/2007 Kosugi

FOREIGN PATENT DOCUMENTS

CN 1700991 A 11/2005
JP 11-123833 A 5/1999
JP 11-192720 A 7/1999
JP 2002-248788 A 9/2002

* cited by examiner

*Primary Examiner*—Anh T. N. Vo
(74) *Attorney, Agent, or Firm*—Sughrue Mion, PLLC

(57) ABSTRACT

A high-performance liquid-supplying system is provided in which cost reduction can be achieved with a simple system configuration and accuracy in detecting the residual amount of liquid is high. An ink-supplying system 1 supplies liquid reserved in a main tank 14 to a recording head 3 through a subtank 16 mounted on a carriage 6. The main tank 14 has a structure opened to the atmosphere, and the subtank 16 has a sealed structure. The subtank 16 has liquid-detecting means 21 including a vibrating plate 31 as a part of a liquid supply channel 18 or a temporary reservoir 16*a* and a piezoelectric actuator 32 provided on the vibrating plate 31.

6 Claims, 1 Drawing Sheet

FIGURE
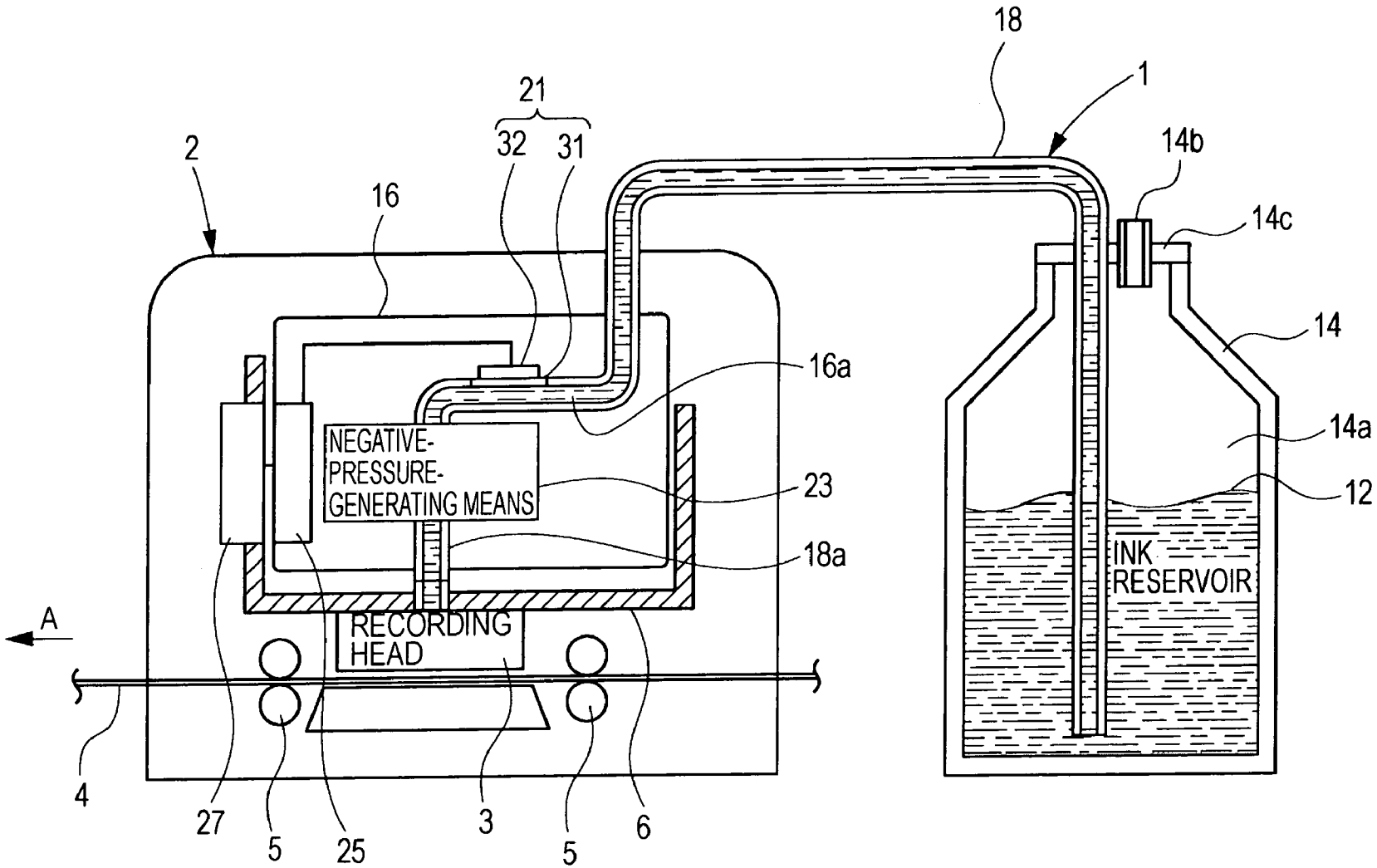

LIQUID-SUPPLYING SYSTEM AND LIQUID-CONSUMING APPARATUS

BACKGROUND

1. Technical Field

The present invention relates to a liquid-supplying system that is installed in a liquid-consuming apparatus including a reciprocating carriage having a head and supplies liquid to the head that consumes the liquid, and to the liquid-consuming apparatus. More particularly, the invention relates to a liquid-supplying system in which liquid reserved in a main tank is supplied to a head through a subtank mounted on a carriage, and to a liquid-consuming apparatus.

2. Related Art

An example of a liquid-consuming apparatus is an ink jet recording apparatus which prints images or the like using a recording head that ejects and applies fine ink droplets onto a recording paper, the recording head being mounted on a carriage reciprocating in a direction orthogonal to a direction in which a piece of recording paper is transported.

Such an ink jet recording apparatus is now used in various printing operations including color printing because it makes a relatively low noise during printing and is capable of forming fine dots at a high density.

For use in such an ink jet recording apparatus, various types of systems for supplying ink to a recording head have been proposed in which ink reserved in a main tank is supplied through a subtank mounted on a carriage.

In an ink-supplying system employing this method, a large amount of ink can be reserved in the main tank. Therefore, frequency of ink change due to ink exhaustion can be reduced and usability of the ink jet recording apparatus can be improved.

The recording head of an ink jet recording apparatus controls ejection of ink droplets by utilizing heat or vibration. If ink in an ink cartridge runs out and an ink-ejecting operation is performed in an inkless state, that is, blank ejection occurs, a malfunction may occur. Therefore, the ink jet recording head needs to be capable of monitoring the residual amount of ink in an ink-supplying system so as to prevent the recording head from performing blank ejection.

In an ink-supplying system in which ink reserved in a main tank is supplied to a recording head through a subtank provided on a carriage, the residual amount of ink is, in general, monitored by one of the following two common methods.

One method employs a sealed-container-type flexible ink pack as a main tank. In this method, ink in the ink pack is supplied to a subtank by applying a pressure to the ink pack and deformation of the ink pack caused by ink consumption is detected, whereby the residual amount of ink is monitored (refer to Japanese Unexamined Patent Application Publication No. 11-192720, for example).

The other method employs an ink reservoir that is opened to the atmosphere to be provided in a subtank mounted on a carriage. In this method, the residual amount of ink is monitored on the basis of the liquid level of ink reserved in the ink reservoir of the subtank (refer to Japanese Unexamined Patent Application Publication No. 11-123833, for example).

However, in the ink-supplying system in which a sealed-container-type flexible ink pack is employed as a main tank so that ink in the ink pack is supplied to the subtank by applying a pressure to the ink pack and the residual amount of ink is monitored by detecting deformation of the ink pack caused by ink consumption, it is problematic that a more complicated system configuration and a higher cost may be required for providing means for pressurizing the ink pack.

It is also problematic that variation in deformation of the ink pack caused by ink consumption may lower accuracy in detecting the residual amount of ink and make it difficult to precisely estimate the timing of ink change or the like on the basis of the residual amount of ink.

Moreover, the main tank cannot be refilled with ink during operation because the main tank has a sealed structure. Therefore, it is inconvenient that the degree of freedom in ink refilling is low.

SUMMARY

An object of the present invention is to solve the above-described problems by providing a high-performance liquid-supplying system in which cost reduction can be achieved with a simple system configuration, the timing of changing liqPursuant to new USPTO rules effective Nov. 1, 2007, Applicant is limited to a single RCE and two (2) continuation applications within an application family. Therefore, for cases under final rejection, such as this one, where a first RCE has already been filed in this application or a continuation application within the same family, please consider filing an RCE, together with a claim amendment, as needed, prior to Nov. 1, 2007. An RCE can no longer be filed in this application, as a matter of right, on or after Nov. 1, 2007.uid can be estimated precisely on the basis of the residual amount of liquid with an improved accuracy in detecting the residual amount of liquid, and a main tank can be refilled with liquid, and also by providing a liquid-consuming apparatus to be applied to the liquid-supplying system.

(1) The above-described problems can be solved by providing a liquid-supplying system that is installed in a liquid-consuming apparatus including a reciprocating carriage having a head and supplies liquid to the head. The system includes a main tank that has an air hole for introducing outside air in accordance with consumption of liquid reserved therein; a subtank that includes a temporary reservoir for temporarily reserving the liquid supplied from the main tank through a liquid supply channel and supplies the liquid in the temporary reservoir to the head, the subtank being mounted on the carriage; and liquid-detecting means that detects presence/absence of the liquid in the temporary reservoir inclusive of the liquid supply channel. The liquid-detecting means includes a vibrating plate as a part of the liquid supply channel or the temporary reservoir and a piezoelectric actuator provided on the vibrating plate.

According to the above configuration, because the main tank is opened to the atmosphere, pressurizing means required for a sealed-type main tank is not required. Accordingly, the system configuration can be simplified and the cost can be reduced.

Further, the liquid-detecting means installed in the subtank is of the piezoelectric type that detects exhaustion of the liquid in the main tank by detecting changes in vibration environment when the residual amount of the liquid in the main tank decreases and the air in the main tank enters the liquid supply channel and the temporary reservoir of the subtank. Therefore, the liquid-detecting means can accurately detect exhaustion of the liquid in the main tank without being influenced by the shape of the main tank and the like.

(2) In the liquid-supplying system described in (1), it is preferable that the subtank further include negative-pressure-generating means for setting a pressure of the liquid supplied to the head to a negative pressure.

According to the above configuration, liquid supply from the main tank to the subtank can be stabilized regardless of the difference between the vertical positions at which the main tank and the subtank are arranged. In other words, because the vertical position of the main tank is not limited, the placement of the main tank becomes more flexible, and designing the placement of the main tank in the liquid-consuming apparatus becomes easier.

(3) In the liquid-supplying system described in (1) or (2), it is also preferable that the subtank further include a memory chip for recording a model number of the liquid-supplying system.

According to the above configuration, when the subtank or the total system needs to be replaced due to exhaustion of the liquid or expiration of the life of the liquid-detecting means, the liquid-consuming apparatus can determine whether the subtank with the correct model number is mounted or not from the model number information recorded in the memory chip of the subtank. This prevents mounting of an incorrect subtank if there is a plurality of similar subtanks to be mounted on one carriage.

(4) In the liquid-supplying system described in any of (1) to (3), it is also preferable that the main tank include a liquid reservoir made of a transparent or semitransparent material.

According to the above configuration, the residual amount of liquid in the main tank can be easily viewed and checked. Therefore, the main tank can be refilled with the liquid before the liquid in the main tank runs out and the air in the main tank enters the liquid supply channel or the temporary reservoir of the subtank. Accordingly, degassing for releasing air that has entered the liquid supply channel or the temporary reservoir of the subtank becomes unnecessary, and overuse of the liquid due to disposal of the liquid that contains gas or similar reasons can be prevented. Thus, the operating cost of the liquid-consuming apparatus can be lowered.

(5) The above-described problems can also be solved by providing a liquid-consuming apparatus to which the liquid-supplying system described in any of 1 to 4 is applied includes a subtank that includes a temporary reservoir for temporarily reserving liquid supplied from a main tank through a liquid supply channel and supplies the liquid in the temporary reservoir to a head, the subtank being mounted on a carriage; and liquid-detecting means that detects presence/absence of the liquid in the temporary reservoir inclusive of the liquid supply channel.

According to the above configuration, the liquid-consuming apparatus can substantially reserve a large amount of liquid in the main tank. Therefore, frequency of changing liquid due to liquid exhaustion can be reduced.

Further, the liquid-detecting means can detect presence/absence of liquid in the subtank inclusive of the liquid supply channel. This prevents occurrence of blank ejection in which ink-ejecting operation is performed with no ink being supplied because liquid is exhausted and air in the main tank enters the liquid supply channel and the subtank.

Because the main tank of the liquid-supplying system and the liquid-consuming apparatus according to the invention is open to the atmosphere, pressurizing means required for a sealed-type main tank is not required. Accordingly, the system configuration can be simplified and the cost can be reduced.

Further, the liquid-detecting means installed in the subtank is of the piezoelectric type that detects exhaustion of the liquid in the main tank by detecting changes in vibration environment when the residual amount of the liquid in the main tank decreases and the air in the main tank enters the liquid supply channel and the temporary reservoir of the subtank. Therefore, the liquid-detecting means can accurately detect exhaustion of the liquid in the main tank without being influenced by the shape of the main tank and the like. Accordingly, the detection accuracy of the residual amount of liquid improves, and replacement timing can be accurately known from the residual amount of liquid.

In addition, because the main tank is open to the atmosphere, the main tank can be refilled with the liquid at any time. Thus, inconvenience that the liquid cannot be refilled at any time is eliminated, whereby convenience is improved.

BRIEF DESCRIPTION OF THE DRAWINGS

These and other objects, characteristics, and advantages of the invention will become apparent from the following description with reference to the accompanying drawings.

FIG. 1 is a schematic diagram of an ink-supplying system and an ink jet recording apparatus as an embodiment of a liquid-supplying system and a liquid-consuming apparatus according to the invention.

DESCRIPTION OF PREFERRED EMBODIMENTS

Now, a preferable embodiment of a liquid-supplying system and a liquid-consuming apparatus, to which the liquid-supplying system according to the invention is applied, will be described in detail with reference to the drawings.

FIG. 1 is a schematic diagram of an ink-supplying system and an ink jet recording apparatus as an embodiment of a liquid-supplying system and a liquid-consuming apparatus according to the invention.

An ink-supplying system 1 of the embodiment is installed in an ink jet recording apparatus (printer) 2 shown in FIG. 1 and supplies ink to a recording head 3 of the ink jet recording apparatus 2.

The ink jet recording apparatus 2 includes a paper transporting mechanism 5 that transports paper 4 in a main direction denoted by arrow A; a carriage 6 installed above a transportation path for the paper 4 so as to be able to reciprocate in a subdirection orthogonal to the transporting direction of the paper 4; the recording head 3 that ejects and applies ink supplied from the ink-supplying system 1 in a form of fine droplets onto the paper 4, the recording head 3 being mounted on the carriage 6; and a control circuit (not shown) that controls the transportation operation of the paper 4, the reciprocation operation of the carriage 6, and the ink ejection operation of the recording head 3.

If the ink jet recording apparatus 2 is regarded as a liquid-consuming apparatus, the recording head 3 corresponds to a head unit that consumes ink by ejecting ink droplets onto the paper 4.

The ink-supplying system 1 according to the embodiment includes a main tank 14 that reserves ink 12 and is disposed at a predetermined position outside the carriage 6 of the ink jet recording apparatus 2; a subtank 16 mounted on the carriage 6; a liquid supply channel 18 that guides the ink 12 reserved in the main tank 14 to the subtank 16; and liquid-detecting means 21 installed in the subtank 16.

The main tank 14 has a bottle-shaped structure and includes an ink reservoir 14*a* provided therein, a cover 14*c* provided on the top of the main tank 14, and an air hole 14*b* provided in the cover 14*c*. The air hole 14*b* introduces air in response to the consumption of the ink 12 reserved in the ink reservoir 14*a*.

In the embodiment, the ink reservoir 14*a* of the main tank 14 is made of a transparent or semitransparent material.

The subtank 16 is shaped so that it can be removably mounted on the carriage 6. The subtank 16 includes a temporary reservoir 16*a* that temporarily reserves the ink 12 supplied from the main tank 14 through the liquid supply channel 18, and supplies the ink 12 in the temporary reservoir 16*a* to the recording head 3. The temporary reservoir 16*a* according to the embodiment is of the sealed type, which does not have an air hole.

The liquid supply channel 18 is a flexible tube, one end of which is inserted into the ink reservoir 14*a* and the other end of which communicates with the temporary reservoir 16*a*.

The subtank 16 includes negative-pressure-generating means 23 that produces a negative pressure in the temporary reservoir 16*a* and the liquid supply channel 18*a* to send the ink 12 in the liquid supply channel 18*a* to the recording head 3.

The subtank 16 further includes a memory chip 25 that records the model number of the ink-supplying system 1. When the subtank 16 is installed in the carriage 6, the memory chip 25 is electrically connected to a control circuit installed in the ink jet recording apparatus 2 through a connector 27 installed in the carriage 6, whereby the recorded information such as the model number is read.

The liquid-detecting means 21 includes a vibrating plate 31 that constitutes a part of the liquid supply channel 18 or the temporary reservoir 16*a*, and a piezoelectric actuator 32 provided on the vibrating plate 31. The propagation characteristic of vibration applied to the temporary reservoir 16*a* by using the vibrating plate 31 (residual vibration) is changed by entry of air into the temporary reservoir 16*a* and the liquid supply channel 18. Thus, the liquid-detecting means 21 detects the presence/absence of the ink 12 (the presence/absence of air) in the temporary reservoir 16*a* inclusive of the liquid supply channel 18, and detects exhaustion of the ink 12 in the ink reservoir 14*a*.

Although a plate dedicated for the vibrating plate 31 may be provided, a wall of the temporary reservoir 16*a* or a wall of the liquid supply channel 18 may be used instead, which leads to a reduction in the number of components.

Because the main tank 14 of the ink-supplying system 1 according to the above-described embodiment is opened to the atmosphere, pressurizing means required for a sealed-type main tank is not required. Accordingly, the system configuration can be simplified and the cost can be reduced.

Further, the liquid-detecting means 21 installed in the subtank 16 is piezoelectric detecting means that detects exhaustion of the ink 12 in the main tank 14 by detecting changes in vibration environment when the residual amount of the ink 12 in the main tank 14 decreases and the air in the main tank 14 enters the liquid supply channel 18 and the temporary reservoir 16*a* of the subtank 16. Therefore, the liquid-detecting means 21 can accurately detect exhaustion of the ink 12 in the main tank 14 without being influenced by the shape of the main tank 14 and the like. Accordingly, the detection accuracy of the residual amount of ink improves, and replacement timing can be accurately known from the residual amount of ink.

In addition, because the main tank 14 is opened to the atmosphere, the main tank 14 can be refilled with the ink 12 at any time. Thus, inconvenience that the ink cannot be refilled at any time is eliminated, whereby convenience is improved.

Further, because the subtank 16 according to the embodiment is of the sealed type, the subtank 16 will not leak the ink 12 to stain areas around the carriage 6.

In addition, the ink-supplying system 1 according to the embodiment includes the negative-pressure-generating means 23 in the subtank 16, which produces a negative pressure in the liquid supply channel 18*a* to send the ink 12 in the liquid supply channel 18*a* to the recording head 3. Therefore, the ink supply from the main tank 14 to the subtank 16 can be stabilized regardless of difference between the vertical positions at which the main tank 14 and the subtank 16 are arranged. In other words, because the vertical position of the main tank 14 is not limited, the placement of the main tank 14 becomes more flexible, and designing the placement of the main tank 14 in the liquid-consuming apparatus becomes easier.

Further, the ink-supplying system 1 according to the embodiment includes the memory chip 25, which records the model number of the ink-supplying system 1, in the subtank 16. Therefore, when the subtank 16 or the total system needs to be replaced due to exhaustion of the ink 12 or expiration of the life of the liquid-detecting means 21, the liquid-consuming apparatus can determine whether the subtank 16 with the correct model number is mounted or not from the model number information recorded in the memory chip 25 of the subtank 16. This prevents mounting of an incorrect subtank if there is a plurality of similar subtanks 16 to be mounted on the carriage 6.

In addition, because the ink reservoir 14*a* of the main tank 14 of the ink-supplying system 1 according to the embodiment is made of a transparent or semitransparent material, the residual amount of ink in the main tank 14 can be easily viewed and checked. Therefore, the main tank 14 can be refilled with the ink 12 before the ink 12 in the main tank 14 runs out and the air in the main tank 14 enters the liquid supply channel 18 or the temporary reservoir 16*a* of the subtank 16.

Accordingly, degassing for releasing air that has entered the liquid supply channel 18 or the temporary reservoir 16*a* of the subtank 16 becomes unnecessary, and overuse of the ink due to disposal of the ink that contains gas or similar reasons can be prevented. Thus, the operating cost of the liquid-consuming apparatus can be lowered.

It is preferable that the subtank 16 be of the sealed type as in the embodiment because the ink in the subtank 16 does not leak from the air hole. However, the liquid-supplying system and the liquid-consuming apparatus according to the invention are not limited to those employing a sealed-type subtank, but may be those employing a subtank that is opened to the atmosphere.

In the case of employing a subtank that is opened to the atmosphere, even when air flows from the main tank into the subtank due to a failure while the ink is still left in the main tank, the air does not flow into an ink-residual-amount sensor because the air is trapped at the subtank.

The application of the liquid-supplying system according to the invention is not limited to the ink-supplying system described in the above embodiment. Likewise, the liquid-consuming apparatus to which the liquid-supplying system according to the invention is applied is not limited to the ink jet recording apparatus described in the above embodiment.

Examples of the liquid-consuming apparatus include various apparatuses in which liquid reserved in the liquid-supplying system is supplied to the apparatus. More specifically, such apparatuses include, for example, an apparatus having a coloring-material ejection head used for manufacturing color filters for liquid crystal displays, etc., an apparatus having an electrode-material (conductive paste) ejection head used for forming electrodes of organic EL displays, surface emitting displays (FEDs), or the like, an apparatus having a living-organic-material ejection head used for manufacturing biochips, and an apparatus having a sample ejection head used as a precision pipette.

The invention claimed is:

1. A liquid-supplying system that is installed in a liquid-consuming apparatus including a reciprocating carriage having a head and supplies liquid to the head, the system comprising:

a main tank that has an air hole for introducing outside air in accordance with consumption of liquid reserved therein;

a subtank that includes a temporary reservoir for temporarily reserving the liquid supplied from the main tank through a liquid supply channel and supplies the liquid in the temporary reservoir to the head, the subtank being mounted on the carriage; and liquid-detecting means that detects presence/absence of the liquid in the temporary reservoir inclusive of the liquid supply channel, wherein the liquid-detecting means includes a vibrating plate as a part of the liquid supply channel or the temporary reservoir and a piezoelectric actuator provided on the vibrating plate.

2. The liquid-supplying system according to claim 1, wherein the subtank further includes negative-pressure-generating means for setting a pressure of the liquid supplied to the head to a negative pressure.

3. The liquid-supplying system according to claim 1, wherein the subtank further includes a memory chip for recording a model number of the liquid-supplying system.

4. The liquid-supplying system according to claim 1, wherein the main tank includes a liquid reservoir made of a transparent or semitransparent material.

5. A liquid-consuming apparatus to which the liquid-supplying system according to claim 1 is applied, the apparatus comprising:

a subtank that includes a temporary reservoir for temporarily reserving liquid supplied from a main tank through a liquid supply channel and supplies the liquid in the temporary reservoir to a head, the subtank being mounted on a carriage; and liquid-detecting means that detects presence/absence of the liquid in the temporary reservoir inclusive of the liquid supply channel.

6. The liquid-supplying system of claim 1, wherein the vibrating plate vibrates in response to entry of the outside air into the liquid supply channel and the temporary reservoir via the air hole, and the piezoelectric actuator detects the presence/absence of the liquid in the temporary reservoir inclusive of the liquid supply channel in response to the vibration of the vibrating plate.

* * * * *